US010912392B2

(12) United States Patent
Scarleski

(10) Patent No.: US 10,912,392 B2
(45) **Date of Patent: *Feb. 9, 2021**

(54) PASSIVE ENCASEMENT ZIPPER CONTAINMENT SYSTEM

(71) Applicant: LEVITATION SCIENCES LLC, Chicago, IL (US)

(72) Inventor: William John Scarleski, Chicago, IL (US)

(73) Assignee: Levitation Sciences LLC, Chicago, IL (US)

( * ) Notice: Subject to any disclaimer, the term of this patent is extended or adjusted under 35 U.S.C. 154(b) by 397 days.

This patent is subject to a terminal disclaimer.

(21) Appl. No.: 15/467,398

(22) Filed: Mar. 23, 2017

(65) Prior Publication Data

US 2018/0014657 A1 Jan. 18, 2018

Related U.S. Application Data

(63) Continuation of application No. 14/302,961, filed on Jun. 12, 2014, now Pat. No. 9,635,954.

(51) Int. Cl.

| | |
|---|---|
| ***A47C 31/00*** | (2006.01) |
| ***A47C 31/10*** | (2006.01) |
| ***A47G 9/02*** | (2006.01) |
| ***A47G 9/04*** | (2006.01) |
| ***A47G 9/00*** | (2006.01) |

(52) U.S. Cl.

CPC ..... *A47C 31/007* (2013.01); *A47C 31/105* (2013.01); *A47G 9/0246* (2013.01); *A47G 9/04* (2013.01); *A47G 2009/001* (2013.01)

(58) Field of Classification Search

CPC ..... A44B 19/301; A44B 19/265; A44B 19/60; A47C 27/002; A47C 31/007; A47C 31/105; A61G 9/0246; A61G 2009/001; Y10T 24/2514; Y10T 24/2591; Y10T 24/2593; Y10T 24/2598; Y10T 24/2511; A47G 9/04

USPC ..... 24/569, 694; 411/512

See application file for complete search history.

(56) References Cited

U.S. PATENT DOCUMENTS 2,521,174 A * 9/1950 Krupp ..... F16L 21/005 24/389
2,928,155 A * 3/1960 Kallio ..... A44B 19/00 24/389
4,604,775 A * 8/1986 Kusayama ..... A44B 19/301 24/384

(Continued)

*Primary Examiner* — Nicholas F Polito
(74) *Attorney, Agent, or Firm* — SmithAmundsen LLC

(57) ABSTRACT

A device is disclosed that provides parasite, dust mite and allergen protection for an encasement used for a mattress or foundation. The device can be part of the original encasement or added as an after-market item to a conventional encasement to prevent the egress of parasites, dust mites and allergens from the gap between the zipper slide and the zipper stop and prevent movement of the zipper slide when the zipper is completely zipped up. The device includes a at least one compressible material that is used. The compressible material is compressed to seal the gap and prevent movement of the zipper slide. In one embodiment of the invention, the device allows the mattress or foundation within the encasement to breathe while blocking parasites, dust mites and allergens from escaping from within the encasement.

19 Claims, 16 Drawing Sheets

(56) References Cited

U.S. PATENT DOCUMENTS

| | | | | |
|---|---|---|---|---|
| 5,231,736 | A * | 8/1993 | Hohenocker | A44B 19/32<br>24/384 |
| 2012/0311785 | A1* | 12/2012 | Goldberg | A47C 31/007<br>5/498 |
| 2013/0117935 | A1* | 5/2013 | Rensink | A47C 31/007<br>5/499 |
| 2013/0255041 | A1* | 10/2013 | Weinstein | A44B 19/301<br>24/387 |

* cited by examiner

PASSIVE ENCASEMENT ZIPPER CONTAINMENT SYSTEM

BACKGROUND OF THE INVENTION

1. Field of the Invention

The present invention relates to a zipper containment system and more particularly to a zipper containment system for use on an encasement for a mattress to prevent the egress of bed bugs, parasites, dust mites and allergens from a zipper that is in a closed position.

2. Description of the Prior Art

Encasements are known to be used as a prophylactic cover over a mattress or box spring to provide protection from various situations, such as parasites, dust mites, allergens and stains, for example, pet stains and stains from incontinent children and adults. As used herein, the term encasement refers to mattress encasements and box spring encasements individually and collectively. Examples of such encasements are disclosed in US Patent Application Publication Nos.: US 2012/0260426; US 2012/0255120; 2012/0192356; 2012/0167302; and 2011/00100856 as well as U.S. Pat. Nos. 8,087,111 and 8,156,588, all hereinafter incorporated by reference.

Such encasements are known to have an opening along one or more sides to enable the encasements to be installed over a mattress or box spring. A zipper is used to close the opening. Unfortunately, even when the zipper is fully closed or zipped up, a small gap exists between the zipper slide and the zipper stop. This gap is normally of sufficient size to allow for the egress of parasites, dust mites and allergens.

In order to prevent the egress of such parasites, dust mites and allergens in encasements, various containment techniques have been developed. For example, US Patent Application No. US 2013/0326820 A1 discloses an encasement, which includes a zipper for enabling a mattress or box spring to be slipped into said encasement. In order to prevent parasites, dust mites and allergens from egressing through zipper opening, a foam pad is stitched to the underside of the encasement adjacent the zipper stop so as to cover a portion of the zipper, the zipper slide and the gap.

There are several problems with the technique discussed above. For example, extra materials and labor are required thus making the encasement relatively expensive to manufacture. In addition, this device relies on a relatively snug fit between the encasement and the mattress so that the mattress compresses the foam against the encasement to seal the gap. As such, the efficacy of the device depends on the relative fit between the encasement and the mattress. Unfortunately, encasements come in all different sizes. If the encasement does not provide a snug fit and compress the foam, the device will be ineffective in preventing the egress of parasites, dust mites and allergens.

In order to solve this problem, other techniques have been developed which eliminate the need for a foam pad and the problems associated with it. For example, U.S. Pat. No. 8,087,111, discloses the use of a flap for covering the zipper slide, the zipper stop and a portion of the zipper. The flap does not provide a positive seal against the zipper tape. As such, even with the flap in a closed position, an exit path exists along the zipper tape allowing parasites and dust mites to escape from the encasement.

U.S. Pat. No. 2,400,731 discloses a mattress encasement, which includes a flap that covers the zipper as well as the zipper slide, zipper stops and the gap. The flap merely covers the gap but does not seal against it. As such, this device allows the egress of parasites, allergens, and dust mites, both into and out of the gap.

Another problem with the devices discussed above is that the containment systems discussed above is that they are currently available only as original equipment devices. Thus, manufacturers must make two different types of encasements; one with a containment system and one without a containment system. As such, these encasements are more expensive to manufacture because of the additional manufacturing process steps to include a parasite proof allergen encasement. Moreover, consumers that own a mattress encasement without a parasite, allergen, and dust mite proof zipper enclosure then must purchase a new encasement with such zipper enclosure protection in order to add parasite protection, which is an added expense for the consumer.

Thus, there is a need for an encasement that can provide a positive compression seal of the gap between the zipper slide and the zipper stop independent of the fit between the mattress and the encasement, as well as a containment system that can be installed as an aftermarket device on an existing encasement to add protection from the egress of parasites, dust mites and allergens.

SUMMARY OF THE INVENTION

Briefly, the present invention relates to a device that provides parasite, dust mite and allergen protection for an encasement used for a mattress or foundation. The device can be part of an original encasement without parasite protection or added as an after-market item to convert such an encasement to one that will provide protection against the egress of parasites, dust mites and prevent movement of the zipper slide. The device includes at least one compressible material that is used to close the gap. The compressible material is compressed to seal the gap and the zipper slide to prevent movement of the zipper slide and to prevent the egress of parasites, dust mites and allergens from inside the encasement. In one embodiment of the invention, the containment device is configured with an air flow communication path to allow the mattress or foundation within the encasement to breathe while blocking parasites, dust mites and allergens from escaping from within the encasement.

DESCRIPTION OF THE DRAWING

These and other advantages of the present invention will be readily understood with reference to the following specification and attached drawing wherein.

DETAILED DESCRIPTION

The present invention relates to a containment device that provides parasite, dust mite and allergen protection for an encasement used for a mattress or foundation and prevents movement of the zipper slide. The containment device can be part of the original encasement or added as an after-market item to a conventional encasement to prevent the egress of parasites, dust mites and allergens from the gap between the zipper slide and the zipper stop when the zipper is completely zipped up and prevent movement of the zipper slide. The containment device includes at least one compressible material that is compressed, as discussed below, in order to seal or close the gap and prevent movement of the zipper slide. In one embodiment of the invention, the containment device includes an air flow communication path to allow the mattress or foundation within the encasement to breathe while blocking parasites, dust mites and allergens from escaping from within the encasement.

Encasements are prophylactic covers used to protect mattresses and foundations from stains and to prevent the egress of parasites, dust mites and allergens. In order to insert a mattress or foundation into an encasement, one or more sides of the encasement are zippered to enable the side(s) to opened up to receive the mattress or foundation. Once the mattress or foundation is properly within the encasement, the zippered side(s) is zippered in order to close the side(s) around the mattress, hereinafter identified as a closed position.

Figure 2:
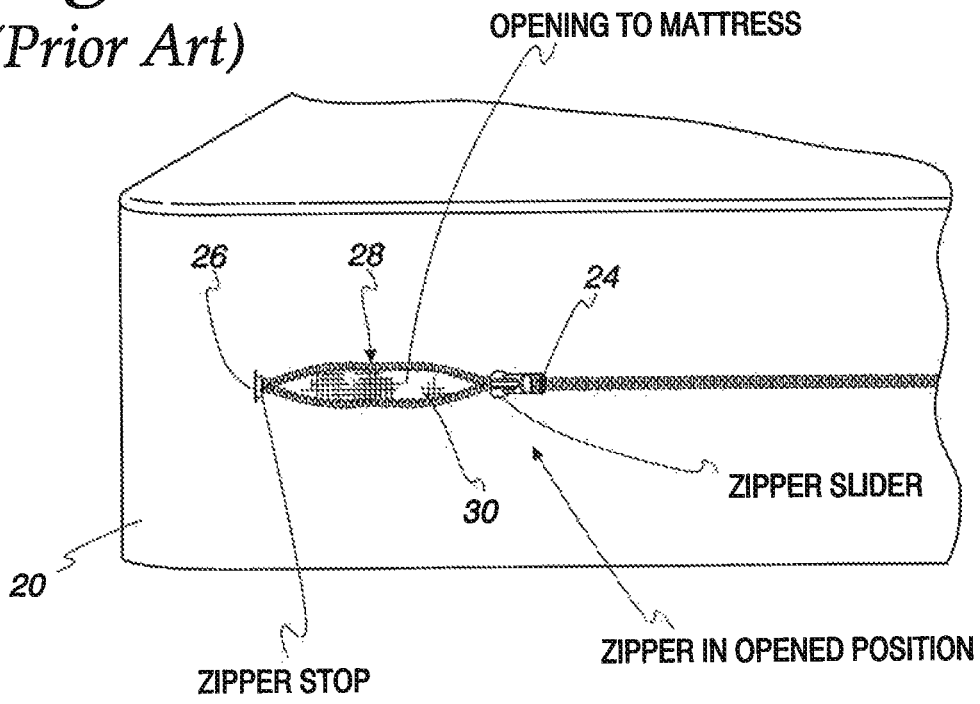
Fig. 2 (Prior Art)
FIG. 2 is a partial isometric drawing of a mattress or foundation disposed within an encasement illustrating the zipper as illustrated in FIG. 1 partially unzipped.
Figure 3:
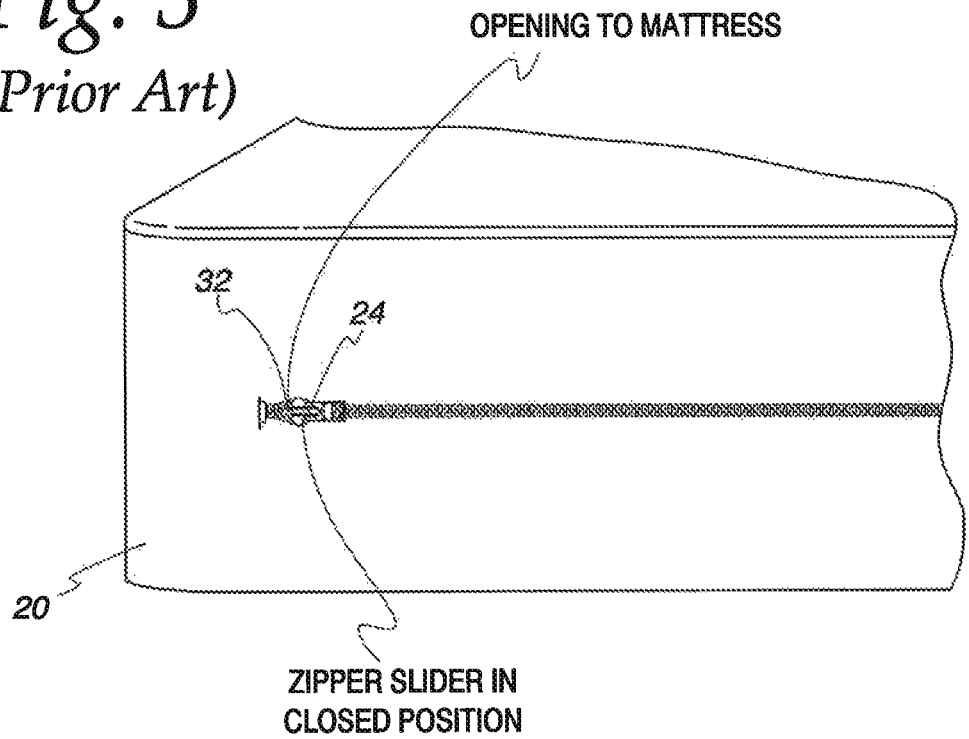
Fig. 3 (Prior Art)
FIG. 3 is similar to FIG. 2 shown with the zipper slider in a closed position
Figure 4:
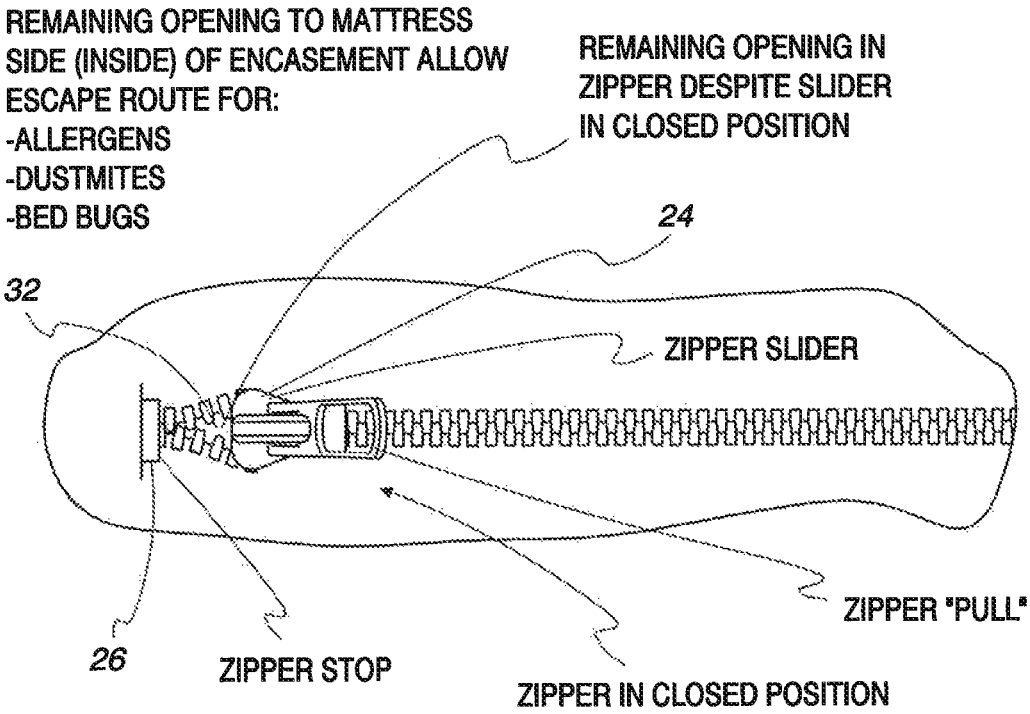
Fig. 4 (Prior Art)
FIG. 4 is a partial expanded view of FIG. 3 with the zipper slider in a closed position illustrating the gap between the zipper slider and the encasement.

FIG. 2 illustrates an encasement 20, which illustrates a zipper, generally identified with the reference numeral 22, in a partially open position in which a portion of the zipper, referred to herein as a zipper slide and identified with the reference numeral 24, is spaced away from a zipper stop 26. As shown in FIG. 2, an open portion of the zipper 22, identified with the reference numeral 28, is exposed to the mattress or foundation 30. Even after the zipper slide 24 is placed in a closed position, as illustrated in FIGS. 3 and 4, a gap 32 still exists. This gap 32 allows the egress of parasites, dust mites and allergens in standard encasements. In order to obtain protection from such parasites, dust mites and allergens, consumers must purchase encasements that are designed to provide protection from such parasites, dust mites and allergens.

The device in accordance with the present invention positively seals the gap mentioned above between the zipper slide and the zipper stop when the zipper is in a closed position to prevent the egress of parasites, dust mites and allergens. In its simplest form the present invention includes at least one compressible material or pad and a compression mechanism. The compressible material is placed over the gap and the zipper slide. The compression mechanism compresses the compressible material or pad thus sealing the gap to prevent the egress of parasites, dust mites and allergens and prevent movement of the zipper slide.

Both elastic and non-elastic compressible materials are contemplated for the compressible material or coatings. As used herein, elastic materials refer to a type of compressible materials that can be compressed but return back to the original position when the compression force is removed. An example of such an elastic material is memory foam, silicone and silicone gel, rubber, Dunlop or talalay foam, rubber or latex, Sorbothane, Santoprene™ rubber or thermoplastics, elastic or nonelastic gel, impact or shock gel, polyurethane gel, gel foam, high or low density viscoelastic polyurethane memory foam (otherwise known as low-resilience polyurethane foam), open cell memory foam or sponge, closed cell foam, neoprene, isoprene, polychloroprene, or materials of like characteristic(s). Elastic materials can be used in re-usable applications.

Non-elastic materials or coatings are defined herein to refer to materials that do not return to their original position when the compression force is removed. An example of such a non-elastic compressible material is felt, cotton batting or padding, wool, nylon, polyester, polypropylene, styrofoam, high-density polyurethane. Non-elastic materials can be used in non-reusable applications. Moreover, non-compressible materials or coatings are also contemplated.

In addition, various embodiments of the invention, as discussed below, contemplate a compression device without additional compressible or non-compressible materials. In these embodiments the containment system merely provides a containment around the gap and zipper slide but does not seal the gap. This containment, though, allows allergens, dust mites, and parasites to escape through the gap, yet these parasites are trapped within the perimeter of the containment. In yet other embodiments, different materials can be used on the inside and outside of the encasement for sealing the gap and containing the zipper slide.

Figure 9:
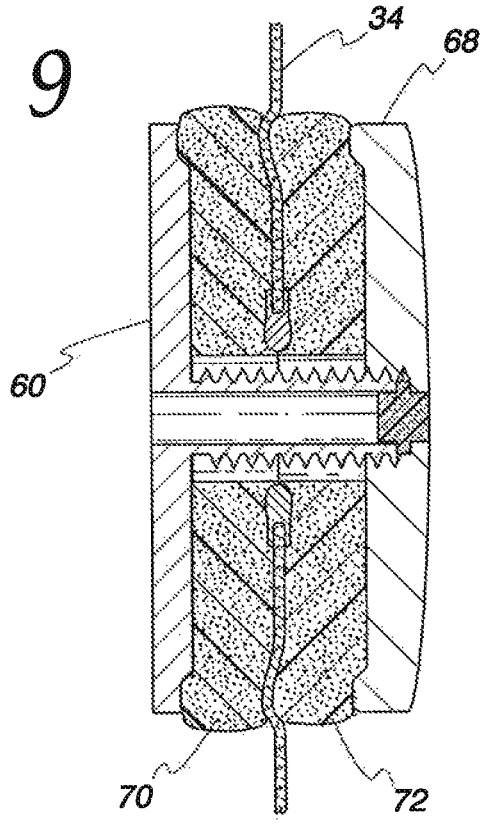
FIG. 9 illustrates an embodiment of the invention in a sealed position, which includes a compressible pad on the inside and the outside of the encasement.
Figure 10:
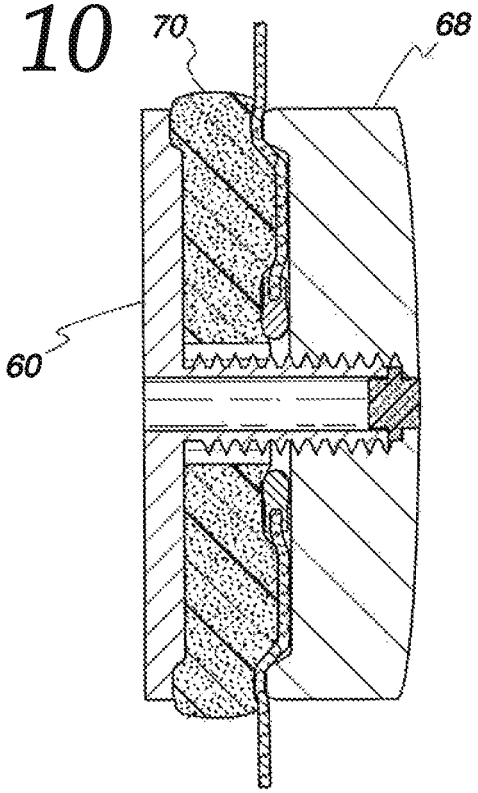
FIG. 10 is similar to FIG. 9 but illustrating only a compressible pad on the inside of the encasement.
Figure 11:
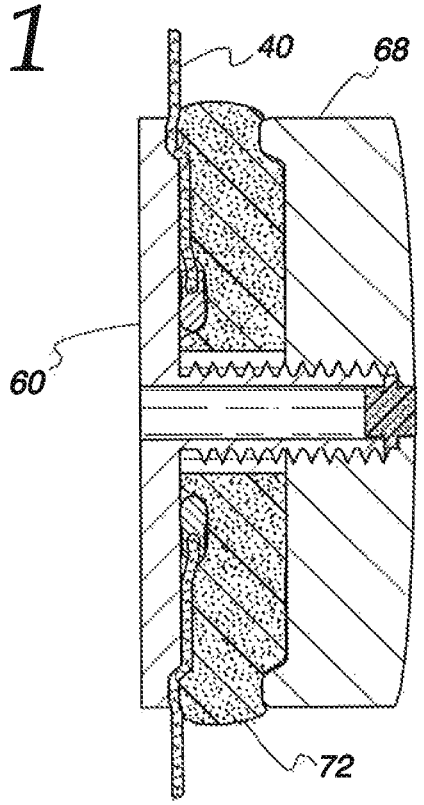
FIG. 11 is similar to FIG. 9 but illustrating only a compressible pad on the outside of the encasement.
Figure 12:
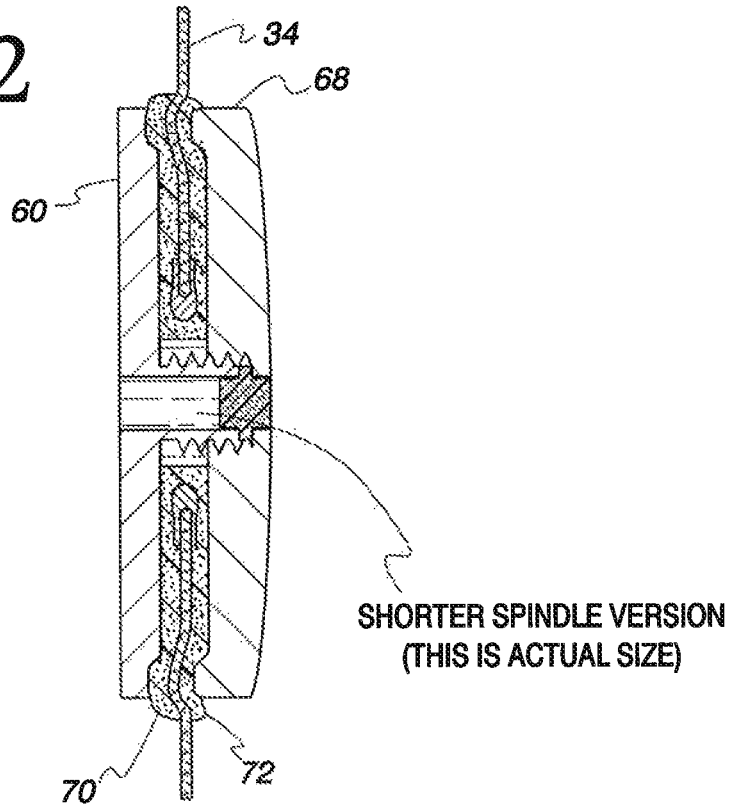
FIG. 12 is similar to FIG. 11 but illustrates a relatively shorter spindle.

Various embodiments of the containment device are contemplated. For example, FIGS. 5-9 and 12 illustrate embodiments in which the compressible materials or pads are disposed on both sides of the gap. In other words, an inside pad covers the gap and zipper slide from the inside of the encasement and an outside pad covers the gap and zipper slide on the outside of the encasement. In this embodiment, a compression mechanism compresses the inside and outside pads together over the gap and the zipper slide, providing a relatively tight and continuous seal relative to the gap and preventing movement of the zipper slide. FIGS. 10 and 11 illustrate embodiments in which one compressible pad is disposed either on the inside or the outside of the encasement. In particular, FIG. 9 illustrates an embodiment in which the compressible pad is disposed on both the inside and outside of the encasement, while FIG. 11 illustrates an embodiment in which the compressible pad is disposed outside of the encasement. In these embodiments in FIGS. 10 and 11, the compressible material is disposed on one side of the gap and compressed between the bearing surfaces of the compression mechanism on the inside and outside of the encasement.

Figure 13A:
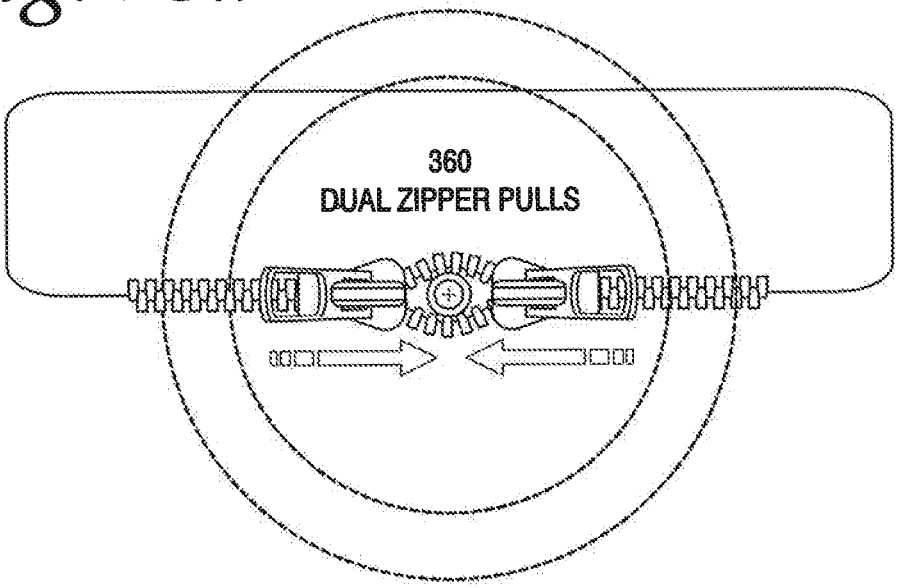
FIG. 13*a* illustrates an embodiment in which the spindle portion of the containment device is disposed between two zipper slides.
Figure 13B:
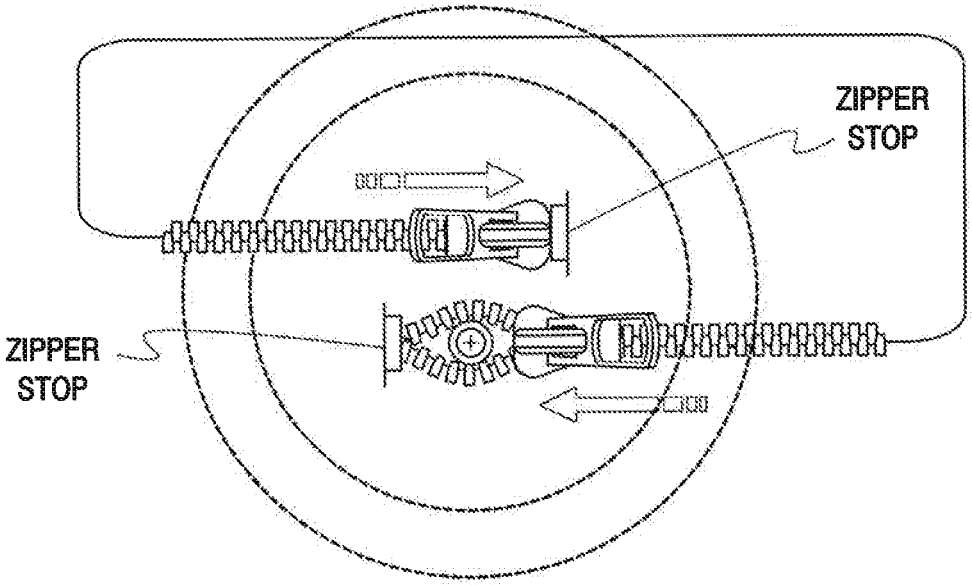
FIG. 13*b* is similar to FIG. 13*a* is similar to FIG. 13*a* but illustrates the spindle portion of the containment device is installed in the gap between one zipper slide and its corresponding zipper stop.

The containment device in accordance with the present invention is amenable to be used with encasements with a single zipper slide that opens on at least one of four sides of the encasement. The containment device is also amenable to being used on encasements with more than one zipper slide, as illustrated in FIGS. 13*a* and 13*b*. FIG. 13*a* illustrates a zipper that circumscribes the entire encasement in a single horizontal plane. FIG. 13*b* is similar but the zipper is in a pseudo spiral configuration so that the zipper stops are in different horizontal planes.

In FIG. 13*a*, the spindle portion of the containment device is disposed between and contains the two zipper slides. In FIG. 13*b*, the spindle portion of the containment device is installed in the gap between one zipper slide and its corresponding zipper stop. The containment device is sized to cover both gaps and zipper slides.

Various shapes and sizes are contemplated for the compressible material. FIGS. 5-8 illustrate the compressible material formed as a disc. Other shapes are contemplated, for example, as illustrated in FIGS. 7*a*-7*c*. The compressible material need only be sized to cover the gap and a portion of the encasement so that the compressible pad seals to the encasement adjacent the gap, as generally shown in FIG. 6.

FIGS. 8-12 illustrate another aspect of the invention. In these embodiments, the compression mechanism includes a hollow spindle or tube that provides an air flow communication path between the inside of the encasement and the outside of the encasement. This configuration allows the mattress or foundation to "breathe" even though the mattress is encased. As such, when weight is applied to the mattress for example due to a person sitting or lying on a bed, air is expelled by way of the air flow communication path. Conversely when the weight is removed, air may be sucked into the encasement.

In order to prevent the egress of parasites, dust mites and allergens during this breathing process, at least one filter or membrane, for example, a HEPA filter is disposed in the air flow communication path. The filter should have a mesh size selected to prevent the egress of parasites, dust mites and allergens outside of the encasement.

Various compression mechanisms are contemplated. FIGS. 5, 6 and 8-12 illustrate compression mechanisms that include a threaded spindle. Other compression mechanisms are also contemplated. For example, bayonet mechanisms are also contemplated. Such compression mechanisms need only provide a compression force that compresses the one or more compressible materials to the surface of the encasement.

Figure 5:
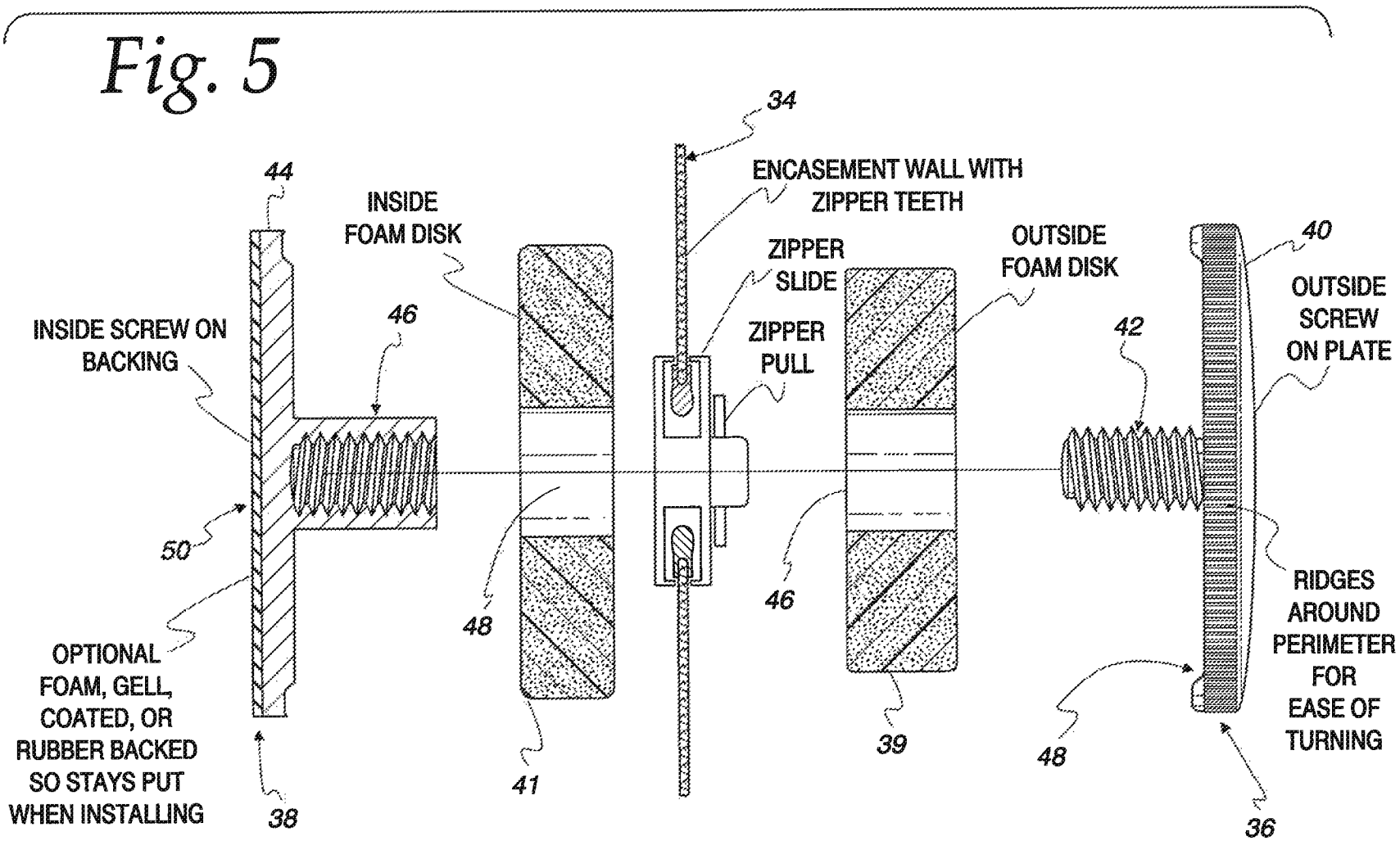
FIG. 5 is an exploded sectional view of one embodiment of the device in accordance with the present invention disposed adjacent to an encasement and zipper pull.
Figure 6:
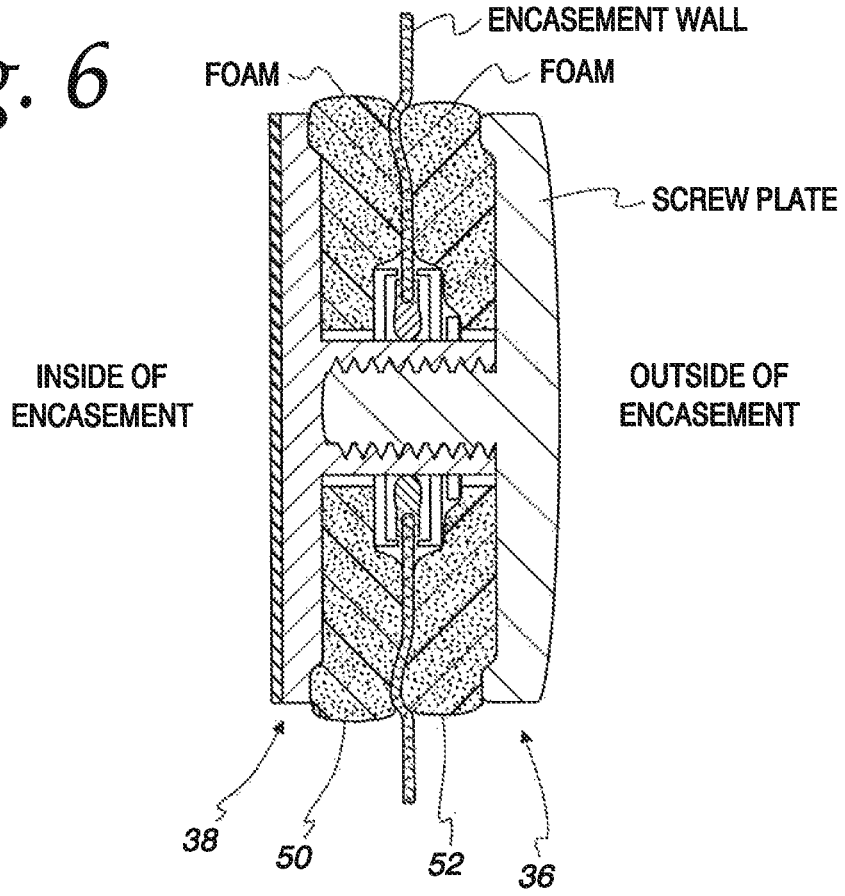
FIG. 6 is an assembled view of the device in accordance with the present invention in a sealed position.
Figure 7A:
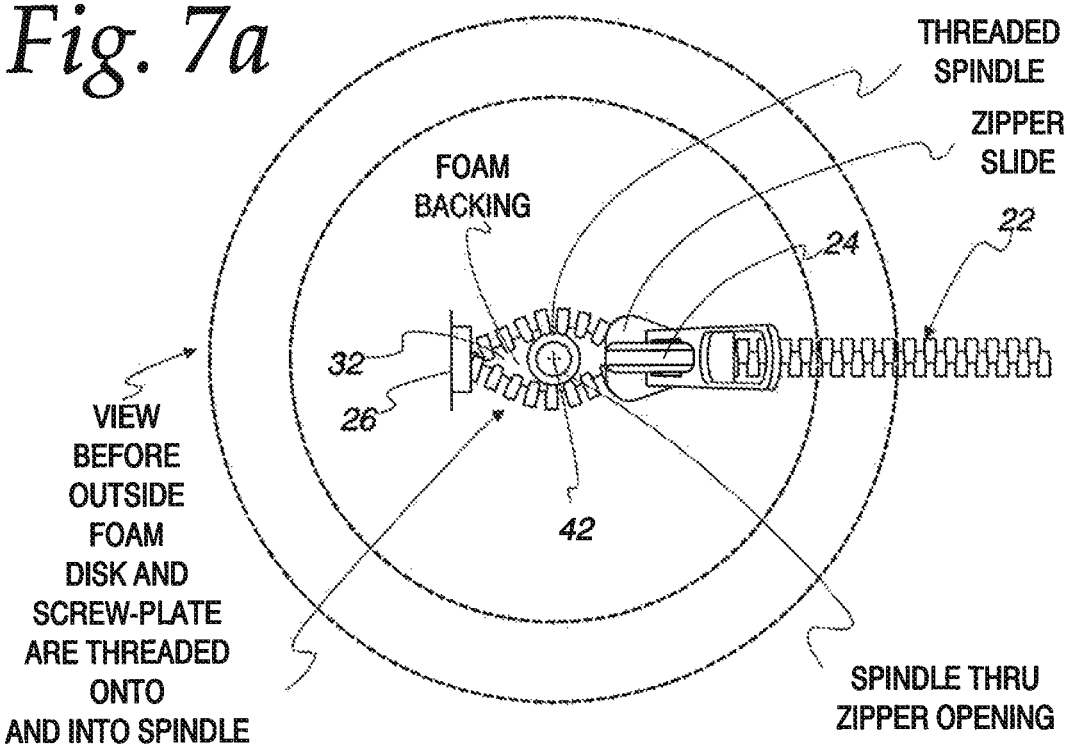
FIG. 7*a* illustrates an embodiment of the containment device used to close and seal the gap between the zipper slide and the zipper stop, illustrating circularly shaped compressible material; shown from the outside of the encasement without the outside compressible pad and compression device.
Figure 7B:
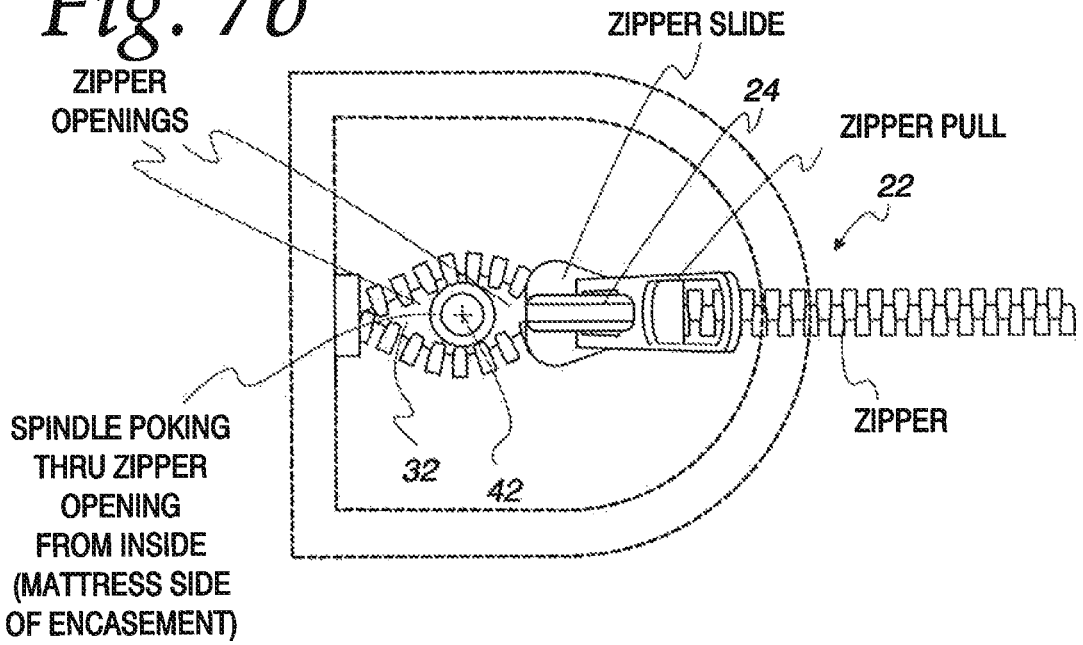
FIG. 7*b* is similar to FIG. 7*a* but shown with an irregularly shaped compressible material.
Figure 7C:
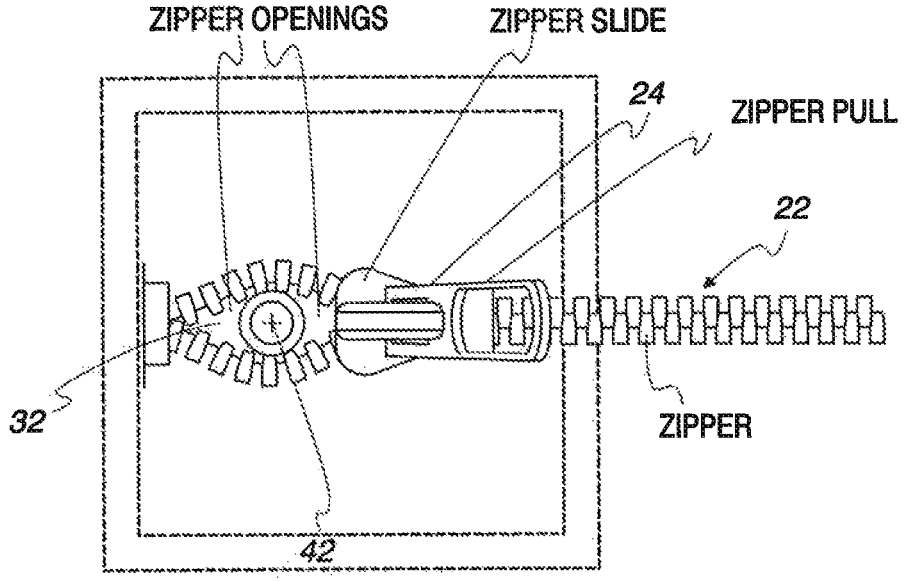
FIG. 7*c* is similar to FIG. 7*a* but shown with a square shaped compressible material.

Referring to FIGS. 5 and 6, an exemplary embodiment of the invention is illustrated. In this embodiment the compression mechanism includes a handle assembly, generally identified with the reference numeral 36 and a backing portion, generally identified with the reference numeral 38, and a first compressible disk 39 outside of the encasement 34 and a second compressible disk 41 inside the encasement 34.

The handle assembly 36 includes a handle, for example, a round handle and an extending threaded stud 42. The backing plate assembly 38 includes a plate portion 44 with an extending bushing, or spindle, portion 46. The bushing portion 46 is tapped to match the threads on the extending stud portion 42. The handle portion 40 may be formed with a radial ring portion 48 along the outside diameter. The inner diameter of the ring portion 48 may be sized to be slightly larger than the outside diameter of a disk 39. The first and second disks 39 and 41 are provided with aligned through holes 46 and 48.

Figure 1:
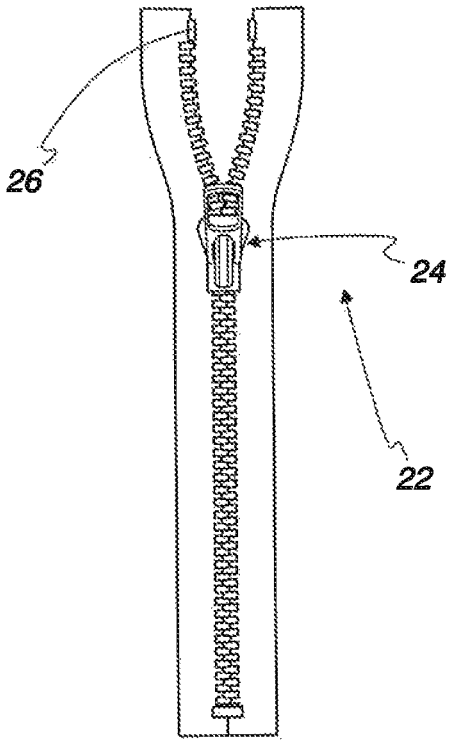
Fig. 1 (Prior Art)
FIG. 1 is a plan view of a conventional zipper shown partially unzipped which identifies the parts of the zipper that will be used herein.

In order to install the device, the zipper 22 (FIG. 1) is opened enough to allow the backing plate 38 and the optional inside pad 41 to be inserted inside of the encasement 34. The tapped bushing portion 46 is inserted into the through hole 48 of the inner pad 41 and disposed adjacent the closed zipper stop 26 (FIG. 2). The threaded stud 42 on the handle portion 36 is disposed in the through hole 46 of the outer pad 39. The threaded stud portion 42 is screwed into the tapped bushing portion 46. The zipper slide 24 (FIG. 4) is zipped as close as possible to the zipper stop 26. The device is situated to cover the gap 32. The device is held in place from the outside by pressing the inner disk 41 and the backing plate 44 while the handle 36 is tightened.

Alternatively, an optional foam, gel, rubber, adhesive, or rubber backing 50 may be disposed on the back of the backing plate 38 for helping hold the backing plate 38 in place during installation.

In an alternate embodiment, a pocket (not shown) may be attached to the inside of the encasement, adjacent the zipper stop. The pocket may be used for holding the inner disk 41 and the backing plate during installation of the containment device.

FIG. 6 illustrates another alternate embodiment using foam or gel instead of a compressible pad. This embodiment is similar to FIG. 5 except foam, identified with the reference numerals 50 and 52, may be disposed on one or both sides of the gap 32 (FIG. 7*a*). Exemplary materials for the foam 50, 52 are as discussed above. In this embodiment, the foam is disposed on the backing plate 38 and the handle 36 before installation, as shown in FIG. 6. The balance of the installation process is as described above.

Figure 8:
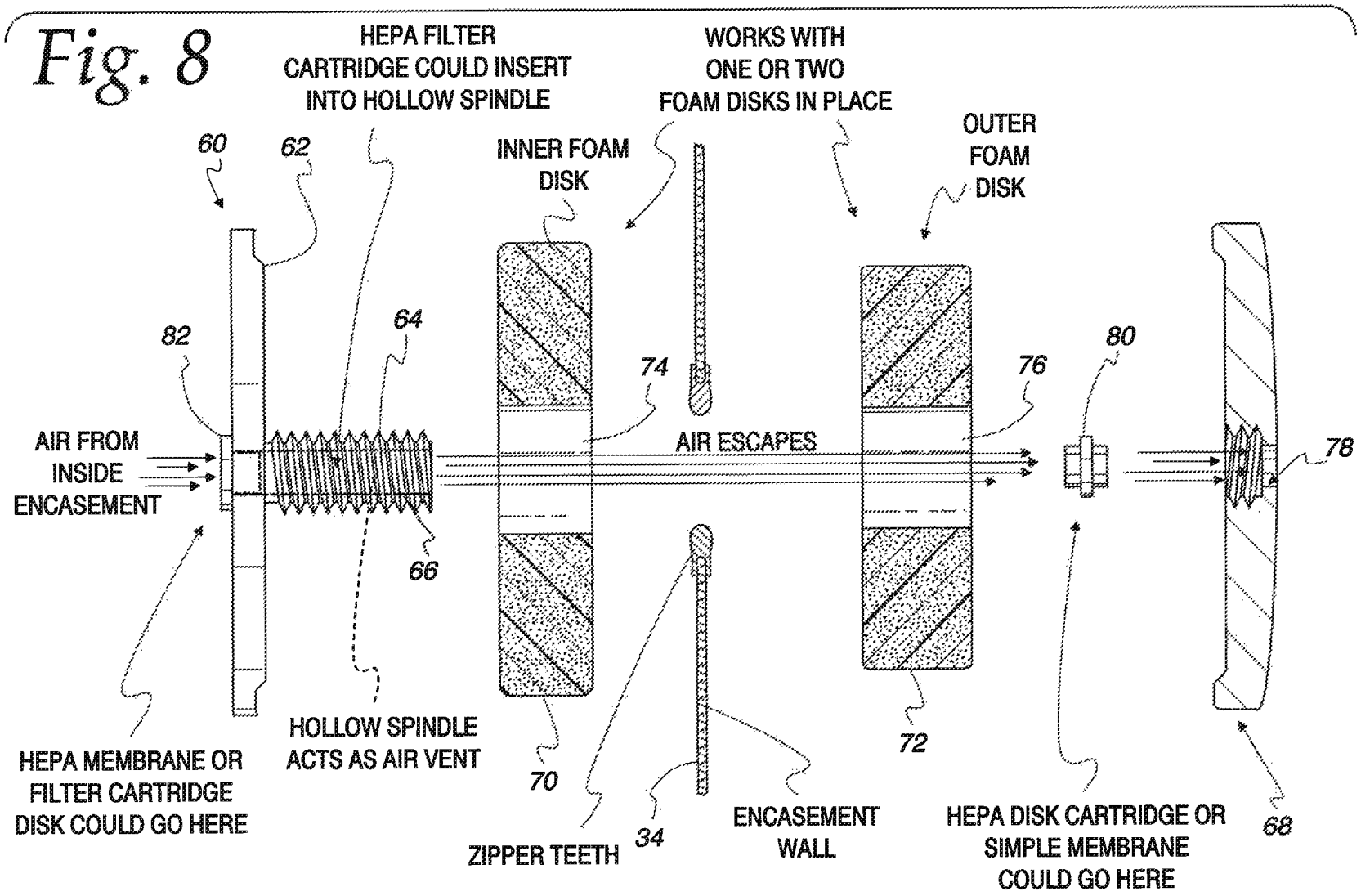
FIG. 8 is an alternate embodiment of the device illustrated in FIG. 5 illustrating the compression device including a hollow spindle for receiving a filter, such as a HEPA filter.

FIG. 8 illustrates an alternate embodiment of the invention. This embodiment is similar to the embodiment in FIG. 5 but includes an air flow communication path between the inside and outside of the encasement. The containment device includes a backing plate 60, that is disposed inside the encasement 34, a handle 68 disposed outside of the encasement 34 and at least one of an inner compressible pad 70 and an outer compressible pad 72, similar to the compressible pads 39, 41 (FIG. 5). These compressible pads 70 and 72 are formed with through holes 74 and 76, respectively, for receiving a hollow spindle 64, as discussed below.

The backing plate 60 includes a plate portion 62 and an extending spindle portion 64 that is threaded on the outside. A through hole 66 extends through the spindle portion 64 and forms the air flow communication path.

The handle 68 is formed from a plate or disk and includes a threaded through hole 78 for receiving the threaded spindle 64.

One or more membranes or filters can be disposed in the air flow communication path to prevent the egress of parasites, dust mites and allergens. These membranes and filters 80 and 82 (FIG. 8) are as discussed above.

In lieu of the membranes and filters 80 and 82 (FIG. 8) the air flow communication path may be closed with a transparent material forming a looking glass. The looking glass may be used for visual inspection of parasites. Parasite bait may be disposed inside the looking glass to attract parasites to facilitate inspection.

The various handles 36 and 68 as well as the backing plates 38 and 60 may be made from various materials. For example, these components can be formed from various thermo-plastic materials or thermoset, including PVC and STC, Polypropylene, very high-density polyurethane, silicone, and made by conventional injection molding techniques. Other materials include hard silicone or vulcanized rubber, metal or material of similar hardness.

Figure 14:
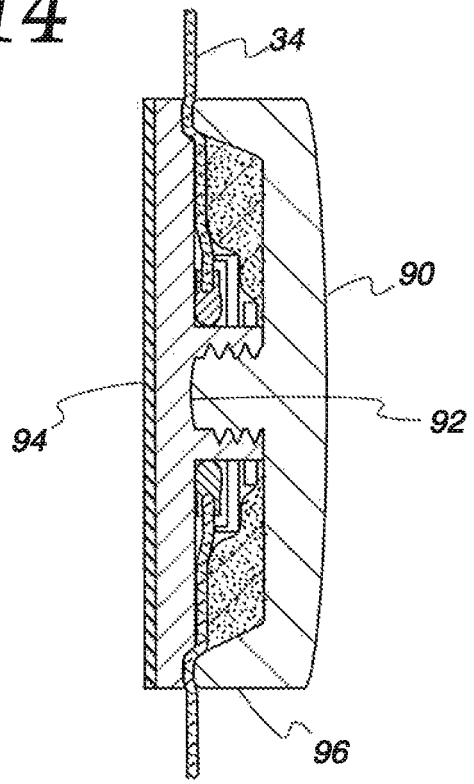
FIG. 14 is a sectional view of an alternate embodiment of the containment system that does not incorporate a compressible pad.
Figure 15:
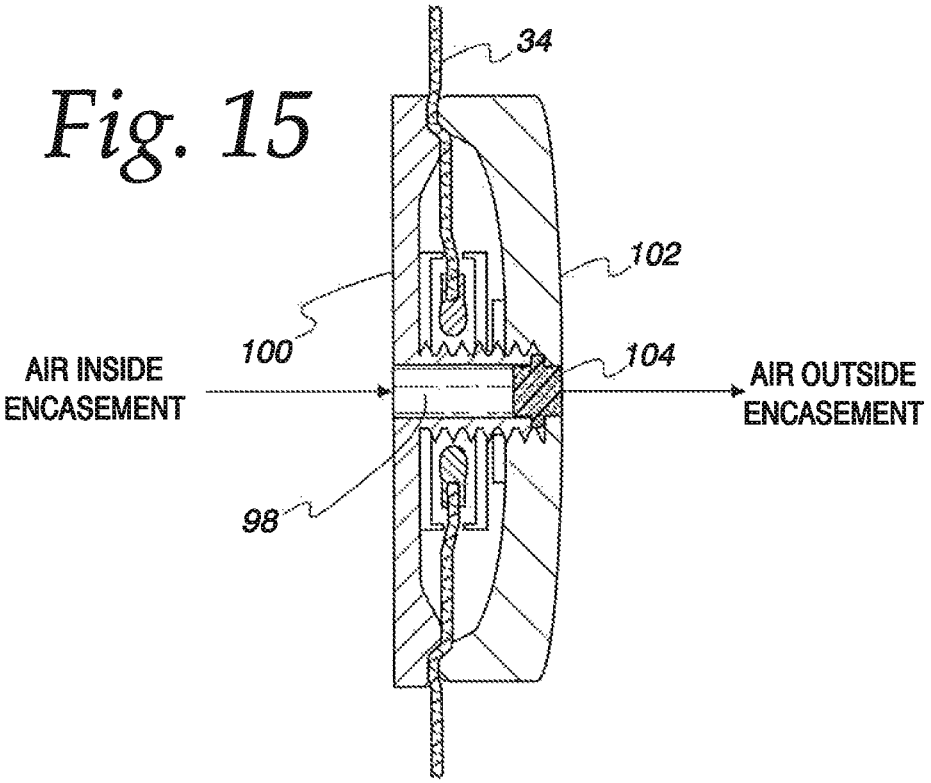
FIG. 15 is similar to FIG. 14 but illustrating a hollow threaded spindle.

FIGS. 14 and 15 relate to alternate embodiments of the containment system. In these embodiments, the gap 30 and zipper slide 24 are contained within a periphery defined by the containment system. In other words, the gap is not sealed nor is the zipper slide prevented from movement. Rather, the containment system provides a peripheral barrier around the area of the gap and the zipper slide. As such, in these embodiments, parasites, dust mites, and allergens can escape through the gap; however, they will be contained within the interior barrier formed by the containment system.

FIG. 14 illustrates an embodiment of a containment system, which includes a handle 90 and an extending spindle 92, and a backing plate 94 with a threaded bore. The spindle portion 92 is inserted into the gap 30 and screwed into an interior threaded formed in the backing plate 94. As shown in FIG. 14, the handle portion 90 is formed with a peripheral ring portion, generally identified with the reference numeral 96. When the handle portion 90 is fully threaded into the threaded bore of the backing plate 94, the ring portion 96 of the handle 90 compresses the encasement against the backing plate 94 forming a barrier around the space immediately adjacent the gap or zipper slide.

FIG. 15 is similar to FIG. 14 but includes a hollow threaded spindle portion 98 which extends from the backing plate portion 100. In this embodiment, the handle portion 102 includes a threaded bore for receiving the threaded spindle 98. The hollow spindle portion 98 provides an air flow communication path from the inside of the encasement to the outside of the encasement. One end of the hollow spindle 98 may be closed with a membrane or an air filter, such as a HEPA filter 104. in this embodiment, the handle portion 102 is similarly formed with a peripheral ring portion 106 which compresses the encasement against the backing plate 100 in order to form a barrier around the gap 30 and the zipper slide 24.

Figure 16:
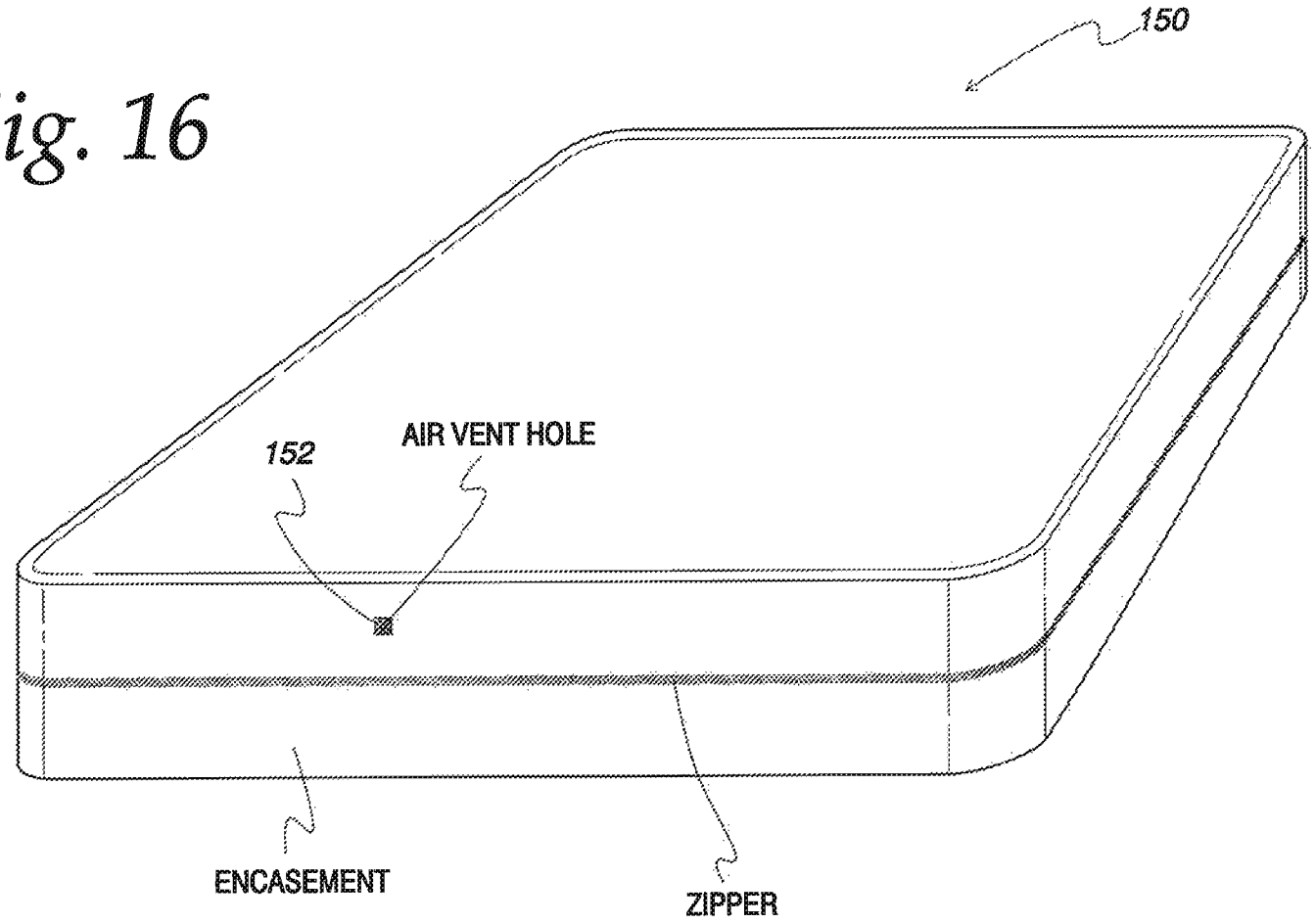
FIG. 16 is a partial isometric elevational view of a mattress with an encasement illustrating and air vent hole.

FIGS. 16 to 21 relate to closure device for sealing optional air vents in an encasement. As illustrated in FIG. 16, a conventional encasement is illustrated with an air vent disposed along one panel of the encasement. The purpose of the air vent is to allow the inside of the encasement to "breathe". This is important in releasing stagnant air in the encasement. More importantly, the air vent allows the air within the encasement to be released when the encasement is being folded to placed into a storage bag, suitcase, or container.

Various embodiments of the closure device are contemplated. These embodiments are illustrated in FIGS. 17*a*-21. Referring first to FIG. 18, this embodiment includes a backing plate 120, one or more optional compressible materials 122, 124 and a handle 126. In this embodiment, the backing plate 120 is formed with a hollow threaded spindle portion 128. The handle portion 126 is formed with a threaded bore 130. Each of the compressible materials 122, 124 include an aligned through hole. At least one filter, such as a HEPA type filter 132, may be installed in the air flow communication path, defined by the hollow spindle 128. In this embodiment, the threaded spindle 128 is received into the through hole of the optional compressible material 122 and into the vent hole 134. A second optional compressible material 124 with its through hole is received onto the threaded spindle 128. The handle 126 is threaded onto the threaded spindle 128 in order to compress the optional compressible materials 122, 124 relative to the vent hole 124.

In alternate embodiments that do not include the compressible materials 122, 124, the handle 126 may be formed with a peripheral ring portion 136. In this embodiment the handle 126 is tightened against the backing portion 120 in order to compress the encasement against the backing plate portion 120.

Figure 19:
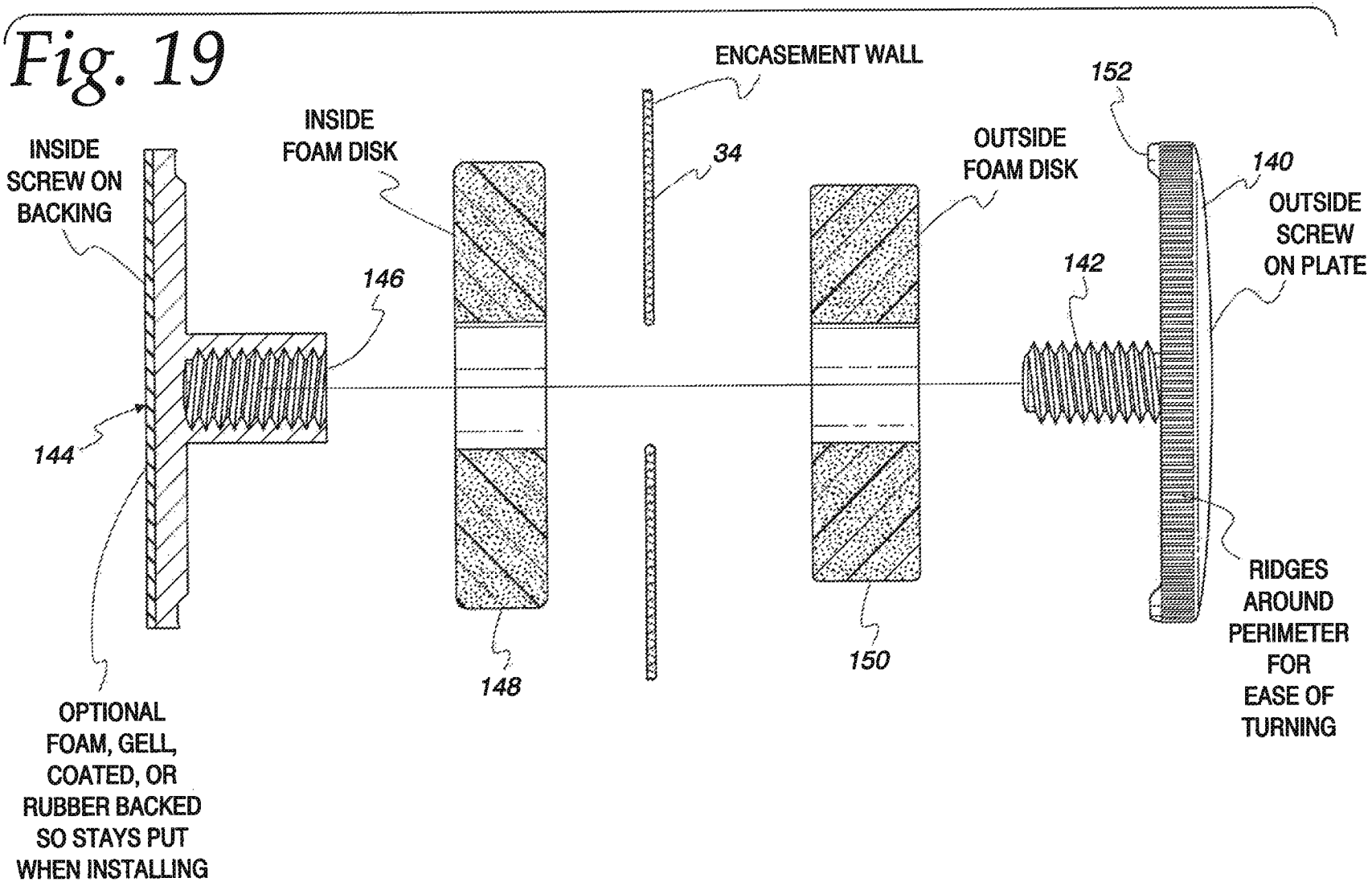
FIG. 19 is an alternate embodiment of the closure system illustrated in FIG. 18.

Referring to FIG. 19, the closure device illustrated in this embodiment includes a handle portion 140 with an extending threaded stud 142, a backing plate portion 144 with an extending bushing having an interior threaded bore 146, and one or more optional compressible materials 148, 150. In this embodiment, each of the compressible material 148, 150 have through holes for receiving the extending bushing on the backing plate. Alternatively, the closure device can be used to form a peripheral barrier around the vent hole 134 without the compressible materials 148, 150. In such an embodiment, the handle portion 140 is formed with a peripheral ring portion 152. In this embodiment, when the handle portion 140 is tightened against the backing plate 144, the peripheral ring portion 152 on the handle portion 140 compresses the encasement against the backing plate 144, thus forming a barrier around the vent hole 134.

Figure 17A:
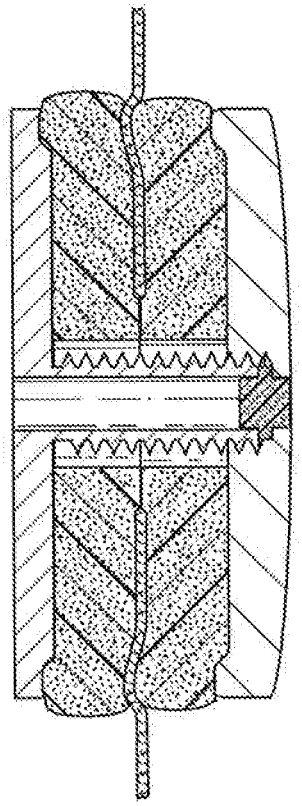
FIG. 17*a* is a partial sectional view in elevation illustrating a closure system for the vent hole illustrated in FIG. 16 illustrating compressible foam pads on the inside and the outside of the encasement.
Figure 17B:
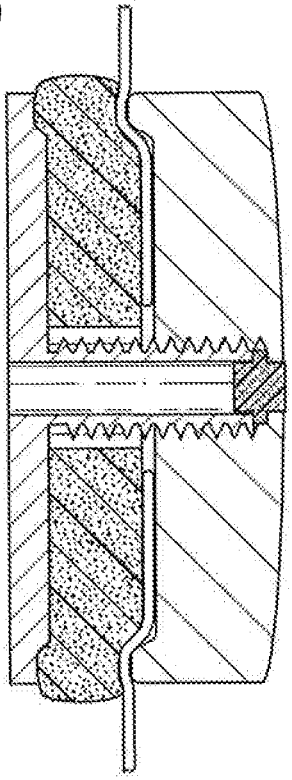
FIG. 17*b* is similar to FIG. 17*a* but illustrating a closure system with a compressible pad only on the inside of the encasement.
Figure 17C:
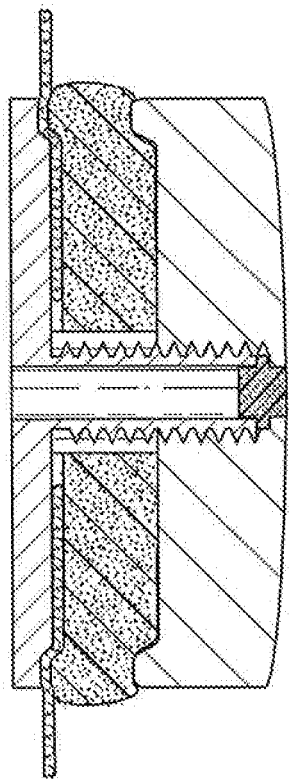
FIG. 17*c* is similar to FIG. 17*a* illustrating a closure system with a compressible pad only on the outside of the encasement.
Figure 17D:
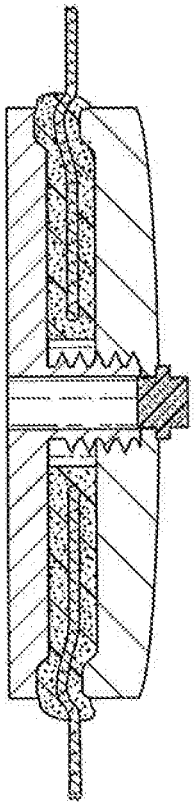
FIG. 17*d* is similar to FIG. 17*a* illustrating a closure system with no compressible pads.
Figure 18:
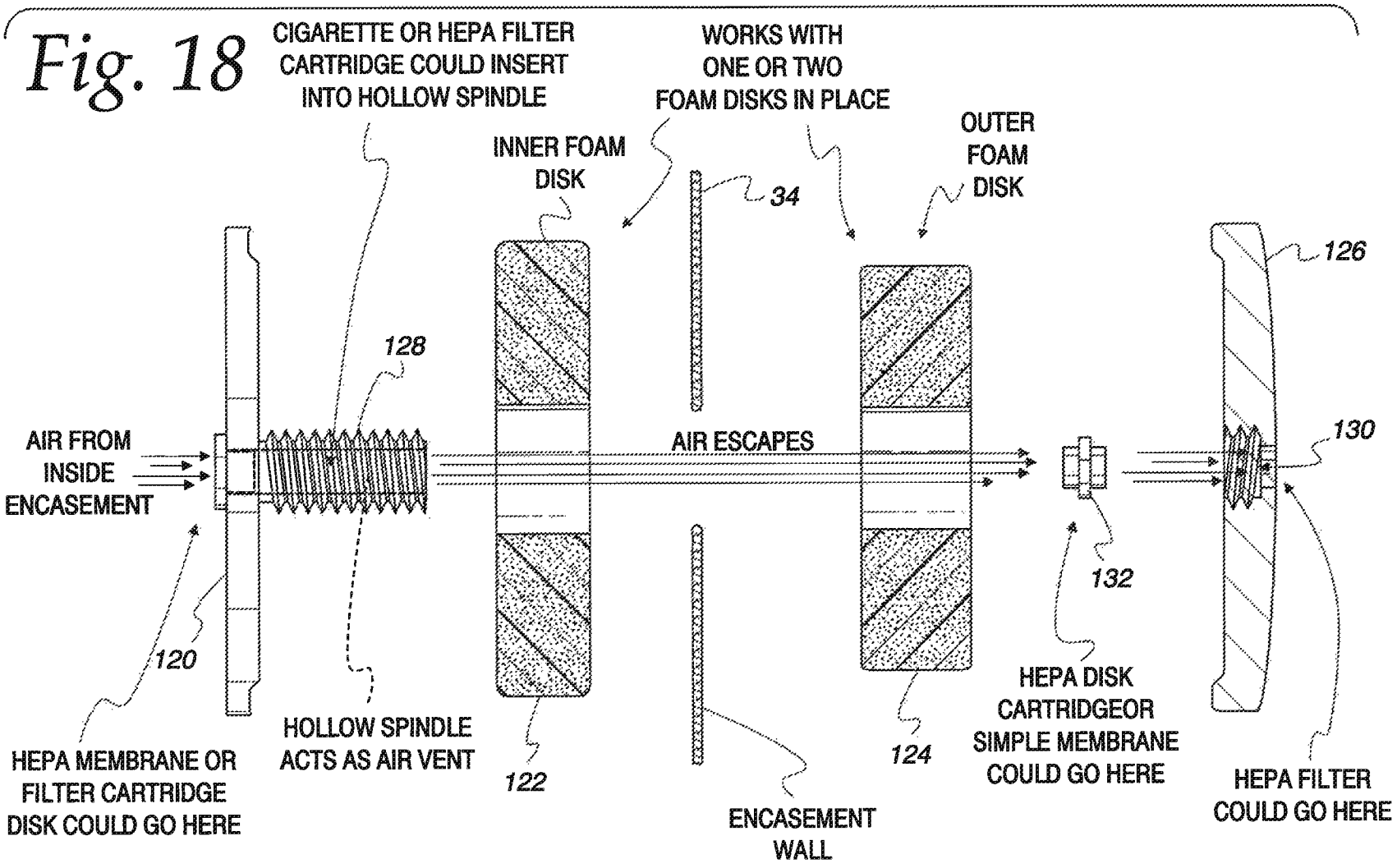
FIG. 18 is an embodiment of a closure system for closing a vent hole in an encasement, as illustrated in FIG. 16, which includes a hollow spindle for allowing air within the encasement to escape.

FIGS. 17*a*-17*d* illustrate alternate embodiments of the invention. FIG. 17*a* illustrates an embodiment in which compressible materials are disposed on the inside and outside of the encasement. FIG. 17*b* illustrates and embodiment in which a compressible material is only disposed on the inside of the encasement. FIG. 17*c* is similar to 17*b* and illustrates an embodiment in which a compressible material is only disposed on the outside of the encasement. FIG. 17*d* illustrates and embodiment that does not incorporate compressible materials.

Figure 20:
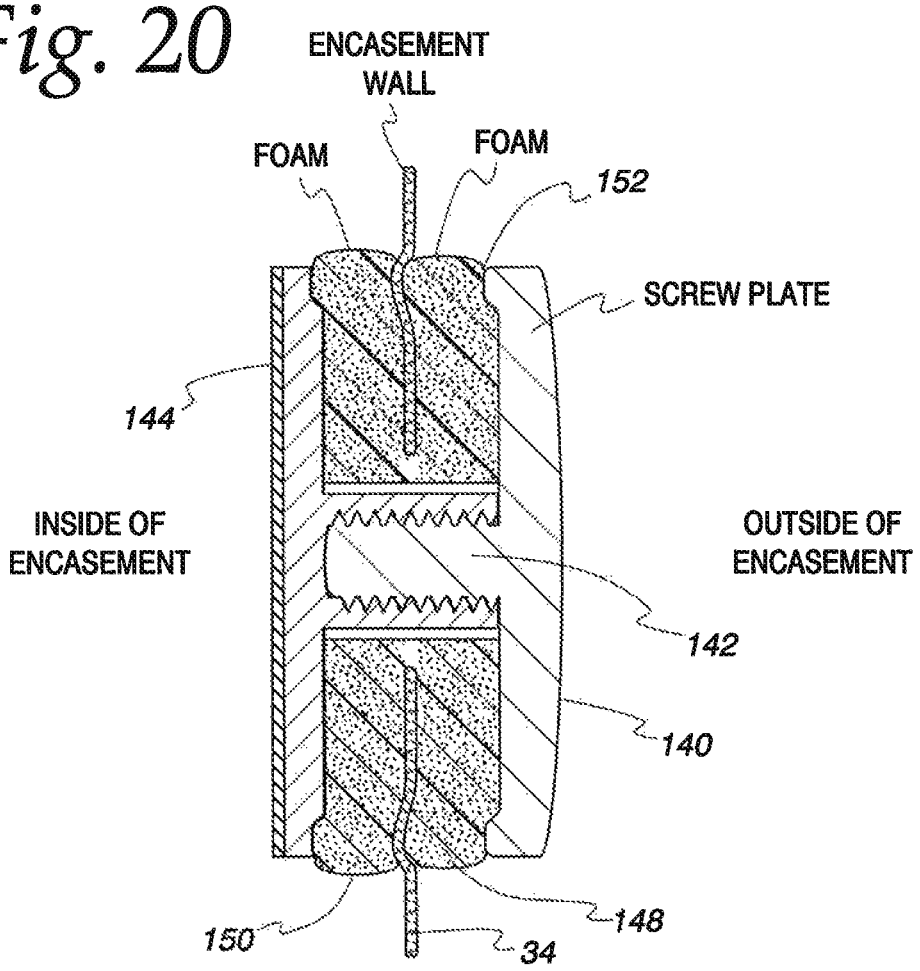
FIG. 20 is a sectional view in elevation of the closure system illustrated in FIG. 19 in a fully closed position.
Figure 21:
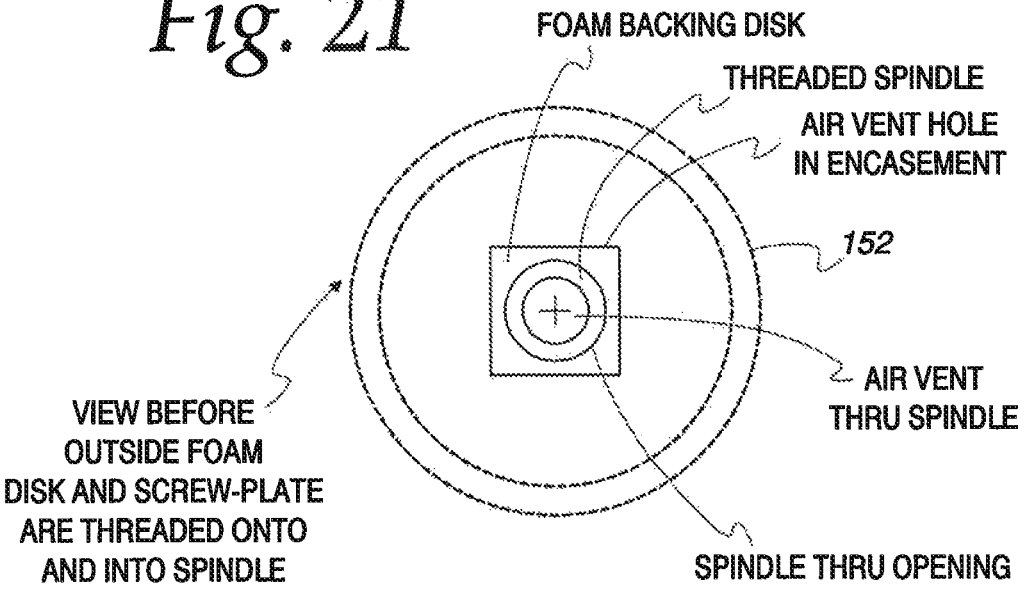
FIG. 21 is a plan view in elevation of the closure system with the closure system illustrated in FIG. 20 with the compressible pad and the handle outside the encasement removed showing the inside compressible pad in phantom.

FIGS. 20 and 21 illustrates a fully assembled closure device. As shown in this embodiment, the threaded spindle 142 of the handle 140 is received into the vent hole 134 and tightened against the backing plate 144. When the handle portion 140 is fully tightened against the backing plate 144 the compressible materials 148, 150 are compressed. The peripheral ring portion 152 also causes the compression of the encasement between the two compressible materials 148, 150.

Obviously, many modifications and variations of the present invention are possible in light of the above teachings. Various types of compression devices are contemplated, such as wing nuts, compression devices with offset spindles, other types of mechanisms for attaching the outside handle or equivalent to the inside backing plate, such as button switches, detent, ratchet systems, and other types of convention mechanisms. Thus, it is to be understood that, within the scope of the appended claims, the invention may be practiced otherwise than as specifically described above.

I claim:

1. A zipper containment system for an encasement for preventing egress of parasites, dust mites and allergens through a gap formed when a zipper slide of the zipper is fully zipped up, the zipper containment system comprising:

a compression material for covering around at least said gap; and a compression device for compressing said compression material and a portion of said encasement together in order to prevent egress of parasites, dust mites and allergens from said encasement, wherein the compression device includes:

a backing plate disposed inside the encasement; and a handle disposed outside the encasement;

wherein the backing plate or the handle of the zipper containment device comprises an extending spindle portion, the extending spindle portion including a through hole that forms an air flow communication path.

2. The zipper containment system as recited in claim 1, wherein said compression material is disposed inside said encasement.

3. The zipper containment system as recited in claim 1, wherein said compression material is disposed outside said encasement.

4. The zipper containment system as recited in claim 1, wherein said compression material is disposed to cover the gap and the zipper slide when the zipper is zipped up in order to additionally prevent unintentional movement of the zipper slide.

5. The zipper containment system as recited in claim 1, wherein said compression material is an elastic compressible material.

6. The zipper containment system as recited in claim 1, wherein said compression material is a non-elastic compressible material.

7. The zipper containment system as recited in claim 1, wherein said zipper containment system is configured to be installed as part of an original encasement.

8. The zipper containment system as recited in claim 1, wherein said compression material is a gel foam.

9. The zipper containment system as recited in claim 1, wherein an outside of the extending spindle portion is threaded.

10. The zipper containment system as recited in claim 9, wherein the handle comprises a threaded through hole configured to receive the threaded extending spindle portion.

11. The zipper containment system as recited in claim 9, wherein the backing plate comprises a threaded bore configured to receive the threaded extending spindle portion.

12. The zipper containment system as recited in claim 1, wherein a membrane or filter is disposed in the air flow communication path.

13. The zipper containment system as recited in claim 1, wherein a transparent material is disposed in the air flow communication path.

14. A method for protecting a mattress or foundation from parasites, dust mites and allergens from an encasement having a zipper which includes a first zipper slide and a zipper stop or second zipper slide and forms a gap between the zipper slide and the zipper stop or the second zipper slide when the zipper is at a fully closed position, the method comprising the step of:

disposing a zipper containment device, comprising a back plate and a handle, adjacent to said gap in order to cover at least the gap between the first zipper slide and the zipper stop or the second zipper slide by:

disposing the backing plate within an inside the encasement;

disposing the handle within an outside of the encasement; and compressing a portion of said encasement around at least said gap by way of said zipper containment device in order to prevent the egress of parasites, dust mites and allergens from the encasement;

wherein the backing plate or the handle of the zipper containment device comprises an extending spindle portion, the extending spindle portion including a through hole that forms an air flow communication path.

15. The method as recited in claim 14 further including the steps of:

disposing a compressible material inside the encasement; and compressing the compressible material and a portion of the encasement around at least said gap.

16. The method as recited in claim 14 further including the steps of:

disposing a compressible material outside the encasement; and compressing the compressible material and a portion of the encasement around at least said gap.

17. A method for protecting a mattress or foundation from parasites, dust mites and allergens from an encasement having a zipper which forms a gap when the zipper is zipped up, the method comprising the step of:

securing a zipper containment device, comprising a back plate and an handle, to an encasement in order to cover around at least the gap as well as a first zipper slide and a zipper stop or a second zipper slide by:

securing the backing plate inside the encasement; and securing the handle outside the encasement; and compressing a portion of said encasement around at least said gap and said zipper slide and the zipper stop by way of said device in order to prevent the egress of parasites, dust mites and allergens from the encasement;

wherein the backing plate or the handle of the zipper containment device comprises an extending spindle portion, the extending spindle portion including a through hole that forms an air flow communication path.

18. The method as recited in claim 17 further including the steps of:

disposing a compressible material inside the encasement; and compressing the compressible material and a portion of the encasement around at least said gap.

19. The method as recited in claim 17 further including the steps of:

disposing a compressible material outside the encasement; and compressing the compressible material and a portion of the encasement around at least said gap.

* * * * *